US006093079A

United States Patent [19]

House

[11] Patent Number: 6,093,079

[45] Date of Patent: Jul. 25, 2000

[54] TOY VEHICLE TRACK

[76] Inventor: William P. House, 9340 N. Shore Trail, Forest Lake, Minn. 55025

[21] Appl. No.: 09/361,887

[22] Filed: Jul. 27, 1999

[51] Int. Cl.[7] ..... A63H 18/00

[52] U.S. Cl. ..... 446/444; 238/10 E; 238/10 F

[58] Field of Search ..... 446/92, 93, 129, 446/134, 135, 137, 431, 444, 445, 446; 238/10 B, 10 E, 10 F; 104/DIG. 1

[56] References Cited

U.S. PATENT DOCUMENTS

| | | | |
|---|---|---|---|
| Re. 30,454 | 12/1980 | Birdsall | 238/10 F |
| Re. 32,106 | 4/1986 | Lemelson | 446/138 |
| 1,829,963 | 11/1931 | Pettibone . | |
| 2,691,946 | 10/1954 | Marmo | 446/129 X |
| 2,983,071 | 5/1961 | Oliver | 446/92 |
| 3,093,919 | 6/1963 | Holtz . | |
| 3,189,981 | 6/1965 | Genin et al. | 446/129 X |
| 3,277,294 | 10/1966 | Howell | 446/129 X |
| 3,734,404 | 5/1973 | Baynes et al. | 238/10 E |
| 3,780,235 | 12/1973 | Deyerl et al. | 191/13 |
| 3,896,582 | 7/1975 | Cohen | 46/17 |
| 4,076,134 | 2/1978 | Landow | 214/38 B |
| 4,140,276 | 2/1979 | Halford | 238/10 R |
| 4,146,991 | 4/1979 | Sano | 46/202 |
| 4,386,777 | 6/1983 | Prehodka | 273/86 B |
| 4,425,735 | 1/1984 | Kulesza et al. | 46/202 |
| 4,496,100 | 1/1985 | Schwager et al. | 238/10 R |
| 4,519,789 | 5/1985 | Halford et al. | 446/444 |
| 4,575,346 | 3/1986 | Ogawa | 446/259 |
| 4,767,053 | 8/1988 | Cook et al. | 238/10 R |
| 4,990,117 | 2/1991 | Yonezawa | 446/136 |
| 5,021,121 | 6/1991 | Ballard | 446/92 |
| 5,075,515 | 12/1991 | Yoneda et al. | 191/22 C |
| 5,165,347 | 11/1992 | Wagner | 104/283 |

FOREIGN PATENT DOCUMENTS

| | | | |
|---|---|---|---|
| 3500533 | 7/1986 | Germany | 446/129 |

*Primary Examiner*—Sam Rimell
*Attorney, Agent, or Firm*—Kinney & Lange, P.A.

[57] ABSTRACT

A toy vehicle track is disclosed for use in guiding and operating a toy vehicle. The toy vehicle track includes several roadway sections of various configurations (e.g., straight, curved, intersecting) having magnetic strips running along each lateral edge. The roadway sections are coupled to each other using magnetic coupling strips placed underneath the magnetic strips on the roadway sections. The toy vehicle track also includes a guardrail designed to fold down undamaged under the application of a force. The track may also include a bridge connected to the various roadway sections.

20 Claims, 9 Drawing Sheets

TOY VEHICLE TRACK

BACKGROUND OF THE INVENTION

The present invention relates to a track that may serve as a roadway for toy cars and trucks. More particulary, it relates to a track that may be quickly and easily assembled into a variety of distinct configurations as required by the user.

Conventional toy vehicle tracks lack the ability to be placed into a variety of distinct configurations, or those configurations can only be accomplished with an excessive amount of time and effort. Various configurations are important to allow the track to be used in locations having limited space and to allow the user exercise creative talents. Ease of assembly is important to allow people of all ages to assemble the track. The track provides a vehicle operating surface and helps develop the skill of the operator in navigating the vehicle around the track. The track should also have the ability to be configured for use with radio-controlled vehicles.

There is a need in the art for a track that may be quickly and easily assembled into a wide variety of configurations and may be used in a variety of operating environments.

BRIEF SUMMARY OF THE INVENTION

The present invention is a toy vehicle track for use in operating a toy vehicle. The toy vehicle track includes a plurality of roadway sections having magnetic strips attached to a lower surface. The track includes at least one magnetic coupling for connecting the roadway sections to each other. The track may include a guardrail coupled to the plurality of roadway sections, the guardrail is disposed normal to and traverses the longitudinal periphery of the plurality of roadway sections. The guardrail is configured to fold down upon application of a downward directed force. The track may include a bridge section. The track may also include intersecting sections for expanding the track complexity. The track may include two roadway sections disposed parallel to each other to provide an increased track width. The track may include a bridge section.

DETAILED DESCRIPTION

Figure 1:
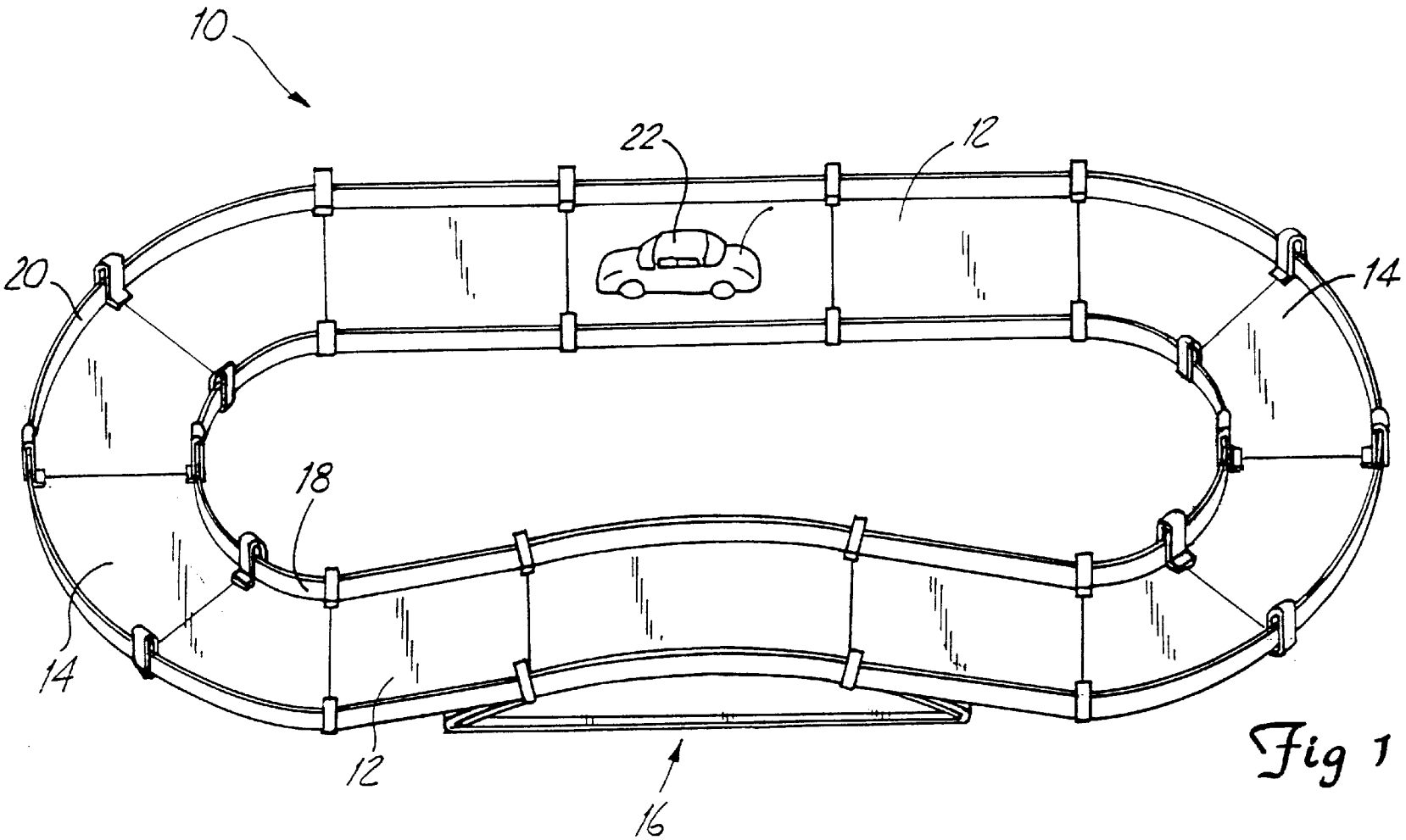
FIG. 1 is a perspective view of a roadway for operating toy cars and trucks according to the present invention.

FIG. 1 shows a perspective view of a track 10 for serving as a roadway for a toy vehicle. The track 10 includes straight roadway sections 12, curved roadway sections 14, a bridge 16, an inner guardrail 18, and an outer guardrail 20. The straight roadway sections 12 and the curved roadway sections 14 are assembled in an end-to-end fashion to form the track 10. The bridge 16 is disposed beneath several of the straight roadway sections 12. The inner guardrail 18 and the outer guardrail 20 extend upward normal to the plane of the straight roadway sections 12 and the curved roadway sections 14. A user may then guide a toy vehicle 22 over the straight roadway sections 12 and the curved roadway sections 14 with the assistance of the inner guardrail 18 and the outer guardrail 20.

During construction of the track 10 according to the present invention, the first step is to connect the straight roadway sections 12 and the curved roadway sections 14 in the desired configuration. The roadway sections 12, 14 are constructed from a soft, flexible rubber material. Specifically, in a preferred embodiment, the roadway sections are manufactured from the elastomeric material EPDM (ethylene propylene diene) and are approximately eight and one half inches wide and 0.0060 inches thick. An advantage of constructing the roadway sections 12, 14 from a flexible rubber material is that the track 10 may conform to the terrain it is placed upon. This allows the track 10 to be used effectively in a wide variety of operating environments. The straight roadway sections 12 may be constructed having any desired lengths. Preferably, the straight roadway sections 12 will be constructed having a variety of lengths.

Figure 2A:
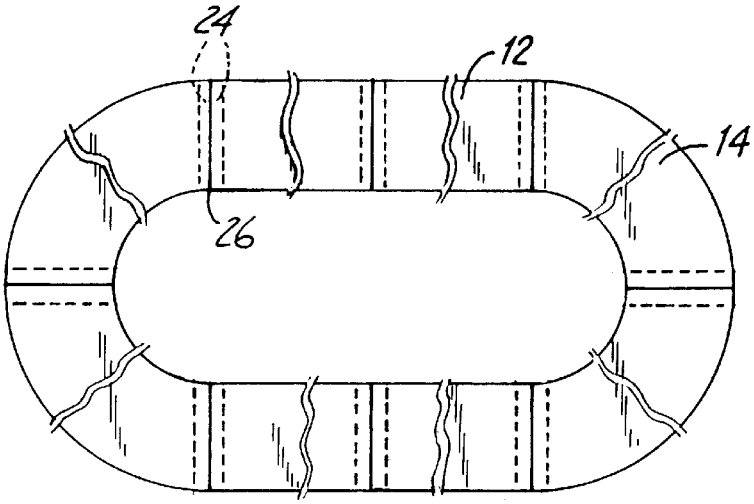
FIG. 2A is a top view of a roadway according to the present invention.
Figure 2B:
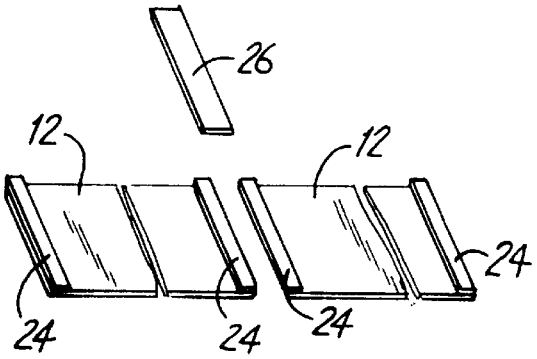
FIG. 2B is an exploded perspective view of the magnetic coupling system of the present invention.

FIG. 2A shows a roadway consisting of straight roadway sections 12 and curved roadway sections 14 assembled in one possible configuration. As best shown in FIG. 2B, the bottom surface of each roadway section 12, 14 has a magnetic strip 24 at each end. FIG. 2B shows an exploded perspective view of two straight roadway sections 12 from the bottom. As shown in FIG. 2B, the magnetic strips 24 traverse each short edge of a bottom side of the roadway sections 12, 14. Two adjoining roadway sections 12, 14 are connected to one another by placing the ends having magnetic strips 24 together and placing the magnetic strips 24 on top of a magnetic coupler 26 (shown at the top of FIG. 2B). A releaseable magnetic coupling is thereby formed between the magnetic strips 24 and the magnetic coupler 26. All components will be described as having a transverse dimension disposed transverse to the track 10 and a longitudinal dimension disposed longitudinally to the track 10. The transverse dimension of the magnetic strip 24 and the magnetic coupler 26 will be greater than the longitudinal dimension.

In a preferred embodiment, the magnetic strips 24 on the roadway sections 12, 14 have a one and one half inch longitudinal dimension and are approximately 0.020 inches thick. The magnetic strips 24 have a transverse dimension approximately equal to the width of the corresponding roadway section 12, 14. The magnetic coupler 26 has a longitudinal dimension of approximately three inches and is approximately 0.020 inches thick. The transverse dimension of the magnetic coupler 26 is substantially equal to the width of the roadway sections 12, 14. In a preferred embodiment, the magnetic coupler 26 a transverse dimension of approximately eight and one half inches. The magnetic coupler 26 is soft and flexible like the roadway sections 12, 14. This coupling system allows a track 10 to be assembled quickly and easily by persons of all ages.

Although the straight roadway sections 12 and curved roadway sections 14 are assembled in the shape of an oval in FIG. 2A, they may just as easily be assembled into an infinite variety of distinct configurations limited only by the user's imagination and the number of roadway sections 12, 14 available. The roadway sections 12, 14 may form a closed loop or may have one or more open ends. Also, the curved roadway sections 14 may be used to turn the track to either the right or the left.

Figure 3A:
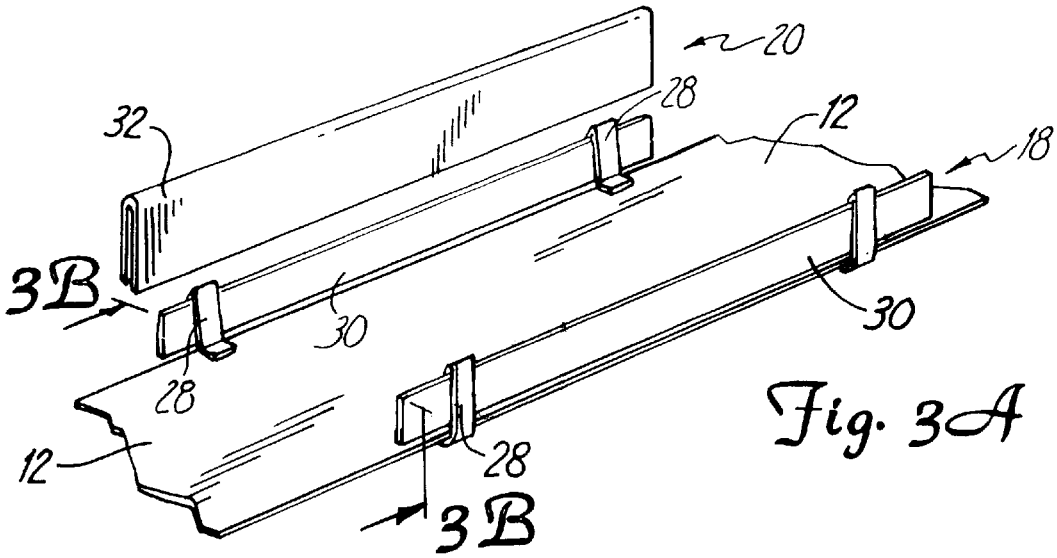
FIG. 3A is a perspective view of a portion of the roadway of FIG. 2A having guardrail supports.
Figure 3B:
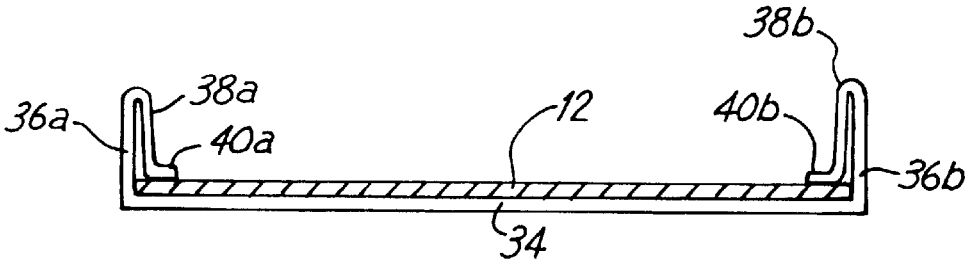
FIG. 3B is a plan view of the roadway of FIG. 3A taken along line 3B—3B.

After the user has assembled a track bed from straight roadway sections 12 and curved roadway sections 14, an inner guardrail 18 may be assembled along the inner periphery of the roadway sections 12, 14 and an outer guardrail 20 may be assembled around an outer periphery of the roadway sections 12, 14. FIG. 3A shows an exploded perspective view of a section of the track 10 showing the components of the inner guardrail 18 and the outer guardrail 20. As shown in FIG. 3A, the outer guardrail 20 includes guardrail supports 28, a guardrail strip 30, and a protective cap 32. The protective cap 32 was omitted in FIG. 1 to allow illustration of the use and placement of the guardrail supports 28. To assemble the guardrails 18, 20, the guardrail supports 28 are placed onto the straight roadway sections 12 and the curved roadway sections 14 at intervals sufficient to support and form guardrail strip 30 to the roadway sections 12, 14 (see FIG. 1). FIG. 3B illustrates how the guardrail supports 28 are attached to a section of the straight roadway track 12. FIG. 3B shows a sectional view of a straight roadway section 12 and a guardrail support 28 taken through the length of one of the guardrail supports 28 in a direction transverse to the straight roadway section 12.

As shown in FIG. 3B, the guardrail support 28 includes a base 34, collapsible supports 36*a*, 36*b*, arms 38*a*, 38*b*, and support tabs 40*a*, 40*b*. The guardrail support 28 is placed onto the straight roadway section 12 such that it is disposed perpendicular to a longitudinal center line of the straight roadway section 12 with the base 34 disposed underneath the straight roadway sections 12. The support tabs 40*a*, 40*b* rest on top of the straight roadway section 12 and provide support. The lengths of collapsible supports 36*a*, 36*b* and arms 38*a*, 38*b* may be adjusted to any desired length to control the height of the guardrails 18, 20. After the guardrail supports 28 are attached to the straight roadway sections 12, the guardrails strips 30 are secured by placing them between the collapsible supports 36*a*, 36*b* and the arms 38*a*, 38*b* as shown in FIG. 3A. Finally, the protective cap 32 is slipped over the top of the guardrail strips 30 and the guardrail supports 28.

In a preferred embodiment, the guardrail supports 28 are constructed from flexible metal or plastic, the guardrail strips 30 are constructed from a thin formable metal or plastic, and the protective caps 32 are constructed from a soft rubber or plastic material. Specifically, the guardrail supports 28 are constructed from 0.015 inch thick plastic banding, the guardrail strips 30 are constructed from twenty-eight gauge metal, and the protective caps 32 are constructed from 0.040 inch thick polyvinyl chloride (PVC).

The guardrail 18, 20 is not necessary for operation of the present invention. The guardrail 18, 20 is advantageous when using the track 10 of the present invention with radio-controlled vehicles. The guardrail 18, 20 assists the user in maintaining the radio-controlled vehicle on the track 10. An advantage of the guardrail support 28, in addition to the adjustable height feature, is the fold-down feature. If the user accidentally steps on or falls on inner guardrail 18 or outer guardrail 20, the collapsible supports 36*a*, 36*b* of the guardrail supports 28 will fold down away from the roadway sections 12, 14. This feature prevents injury to the user and prevents damage to any portion of the track 10. The guardrail 18, 20 may be given greater stability by placing the support tabs 40*a*, 40*b* below the roadway sections 12, 14. In this configuration, the weight of the roadway sections 12, 14 on the support tabs 40*a*, 40*b* will provide resistance to folding of the guardrail support 28.

Figure 4A:
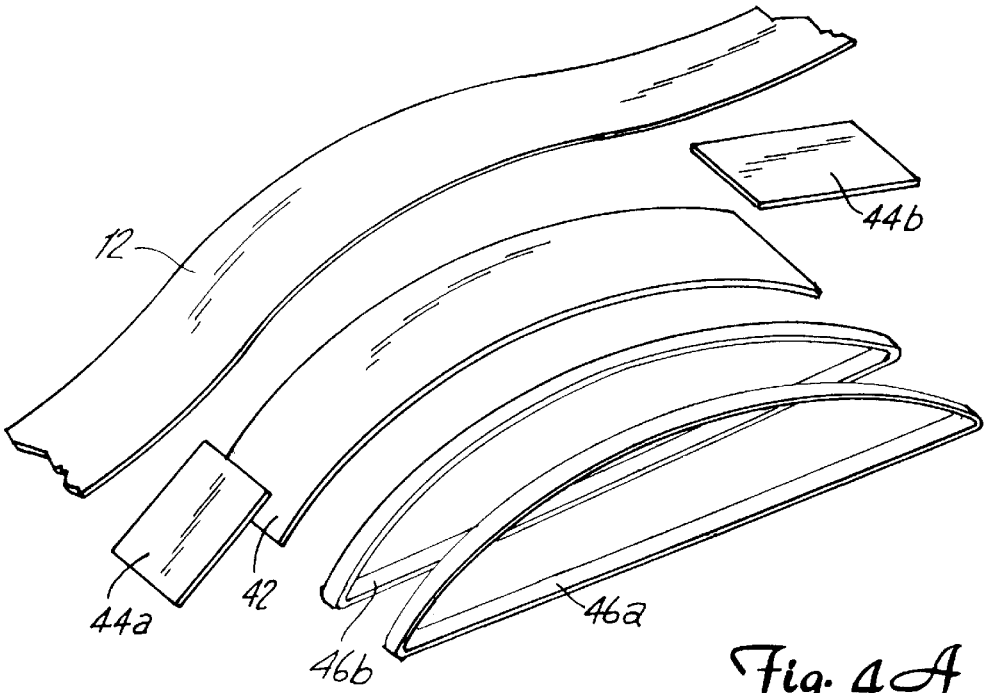
FIG. 4A is a perspective view of a roadway including a bridge.
Figure 4B:
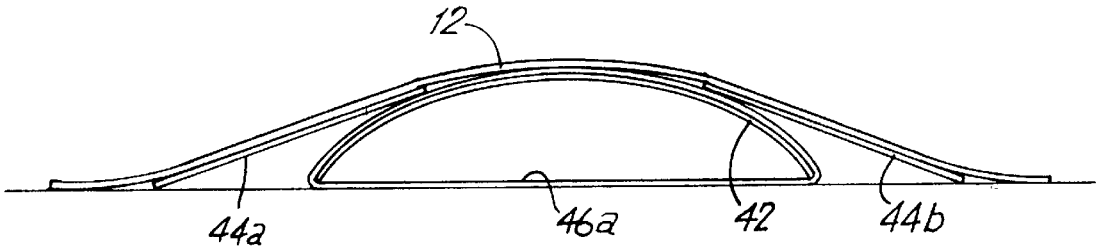
FIG. 4B is a sectional view of the bridge shown in FIG. 4A.

For some configurations of track 10, a bridge 16 may be included. As shown in FIG. 4A, the bridge 16 includes a support surface 42, entry ramps 44*a*, 44*b*, and fastening loops 46*a*, 46*b*. Bridge 16 is assembled by bending the support surface 42 and attaching the fastening loops 46*a*, 46*b* around an outer periphery of the support surface 42 to secure it in a curved position. The fastening loops 46*a*, 46*b* are continuous lengths of material which, when placed around the bent support surface 42, prevent the support surface 42 from straightening. The fastening loops 46*a*, 46*b* are constructed from plastic banding of a length appropriate to sustain curvature in the support surface 42. The amount of curvature in the support surface 42 shown in FIGS. 4A and 4B is exaggerated for purposed of illustration. In a preferred embodiment, the amount of curvature of the support surface 42 is less.

The fastening loops 46*a*, 46*b* are attached by bending the support surface 42 and slipping the fastening loops 46*a*, 46*b* over an exterior surface. One of the fastening loops 46*a*, 46*b* is placed near each outer edge of the support surface 42. Entry ramps 44*a*, 44*b* are then used to transition from the roadway section 12, 14 to the support surface 42. The entry ramps 44*a*, 44*b* are bolted to the support surface 42 at a first end and are supported by the floor at a second end.

In a preferred embodiment, the support surface 42 and the entry ramps 44*a*, 44*b* are constructed from Masonite™ having a thickness of approximately 0.25 inches. In a preferred embodiment, the fastening loops 46*a*, 46*b* are approximately one half inch wide.

Once the bridge 16 is assembled, the straight roadway sections 12 may be placed directly on the bridge support surface 42 and entry ramps 44*a*, 44*b* as shown in FIGS. 4A and 4B. The guardrails 18, 20 traversing the length of the bridge 16 are constructed from guardrail strips 30 and protective caps 32 having a curvature appropriate to conform to the surface of the bridge 16 (as shown in FIG. 1).

Figure 5A:
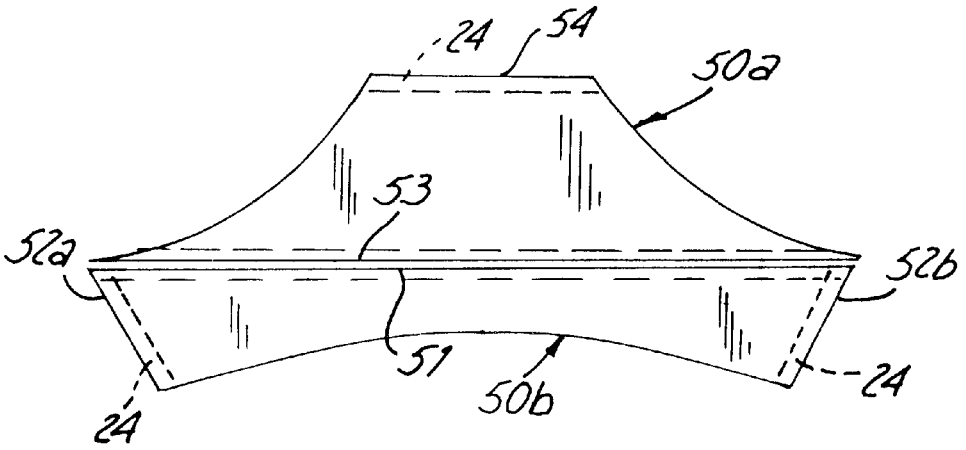
FIGS. 5A–5C show track pieces for intersecting with the track section shown in FIG. 2A.
Figure 5B:
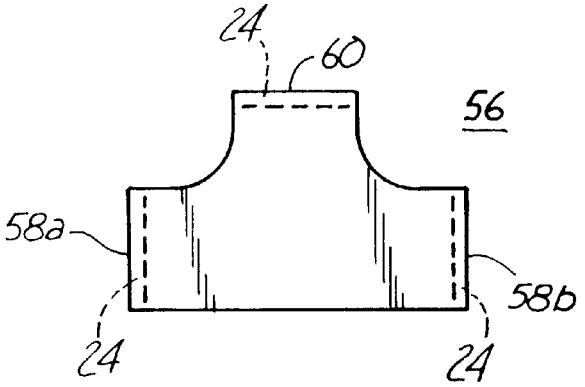
Figure 5C:
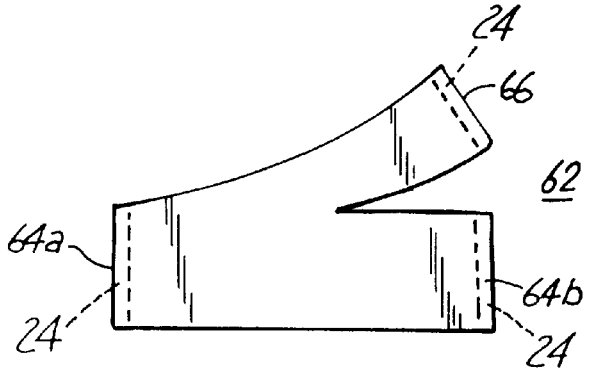

The track 10 may also include intersecting pieces as shown in FIGS. 5A–5C. FIG. 5A illustrates a radius intersection 50 for use with the present invention. The radius intersection 50 is constructed from two components, a straight intersection 50*a* and a radius piece 50*b*. The radius piece 50*b* has an exit 51 and curved roadway ends 52*a*, 52*b*. The straight intersection 50*a* has an entrance 53 and a new roadway end 54. Each of the ends 51, 52*a*, 52*b*, 53, 54 has a magnetic strip 24 adhesively fastened to a lower side for coupling to other roadway sections by using a magnetic coupler 26. The width of the exit 51, the entrance 53, and the new roadway end 54 may be varied depending on whether the user wishes to connect a single-width roadway or a dual-width roadway (the dual-width roadway is discussed in detail below). Also, the width of the curved roadway ends 52*a*, 52*b* may be varied depending upon whether the user wishes to intersect upon a single-width roadway or a dual-width roadway. Further, the straight intersection 50*a* can be used by itself to intersect with a straight roadway section 12. In this case, the user must add a magnetic strip 24 to the appropriate portion of the straight roadway section 12.

FIG. 5B shows a straight intersecting section 56 for use in assembling a track 10 according to the present invention. The straight intersecting section 56 has two intersecting ends 58*a*, 58*b*, and a new roadway end 60. The ends 58*a*, 58*b*, 60 have a magnetic strip 24 adhesively fastened along a lower side. Again, the widths of the ends 58*a*, 58*b*, 60 may be adjusted appropriately depending upon the width of roadway sections to which they will be coupled.

FIG. 5C shows a Y-type intersecting section 62 for use in assembling a track 10 according to the present invention. The Y-type intersecting section 62 includes intersecting ends 64*a,* 64*b* and a new roadway end 66. Each of the ends 64*a,* 64*b,* 66 has a magnetic strip 24 adhesively bonded to a lower surface. Once again, the respective widths of the ends 64*a,* 64*b,* 66 may be adjusted for use with either a single-width or dual-width roadway section. Each of the intersecting sections 50, 56, 62 may be used to create branches from an original track 10 and increase the size and complexity of the track 10. The intersection sections 50, 56, 62 may be coupled to each other or to the roadway sections 12, 14 using a magnetic coupler 26 and the magnetic coupling method discussed above.

Figure 6:
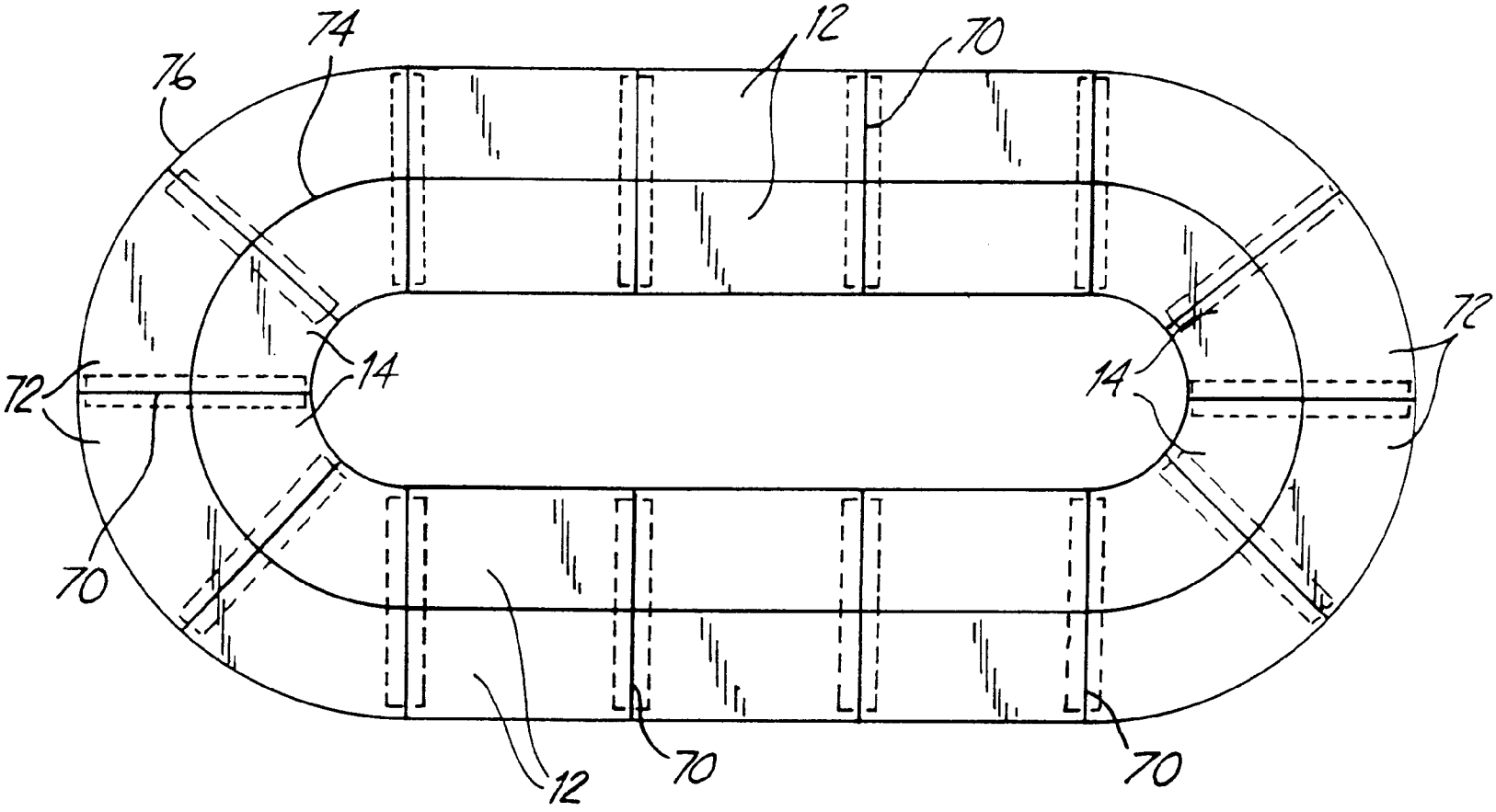
FIG. 6 is a top view of a dual-width roadway of the present invention.

Another feature of the present invention is that the roadway surface of track 10 may be of several different widths. As illustrated in FIG. 6, the present invention provides the user with the option of a dual-width roadway surface. The width of the track 10 may be increased by laying two straight roadway sections 12 next to each other in a side-by-side manner. For instance, two straight roadway sections 12 may be placed side-by-side to double the width of the roadway surface as shown in FIG. 6. In a preferred embodiment, this would result in a roadway surface approximately seventeen inches wide. As shown in FIG. 6, two straight roadway sections 12 are coupled to one another in a side-by-side manner by using a magnetic coupler 70. The magnetic coupler 70 is generally the same as the magnetic coupler 26 except that magnetic coupler 70 is twice as wide to accommodate two straight roadway sections 12. In a dual-width roadway, the magnetic coupler 70 acts to couple roadway sections both side-by-side and end-to-end.

As shown in FIG. 6, the width of a curved roadway portion 14 may be widened by placing a large radius roadway section 72 (shown on both the far left and far right in FIG. 6) on the outside of the curved roadway section 14. The large radius roadway section 72 has an inner radius 74 and an outer radius 76. The large radius roadway section 72 has a greater radius of curvature than and is configured to mate with an outer edge of the curved roadway section 14. In other words, the large radius roadway section 72 and the curved roadway section 14 are configured as portions of concentrically disposed circles. The inner radius 74 is approximately the same as the radius at the outer edge of the curved roadway section 14.

As shown in FIG. 6, the large radius roadway section 72 has an inner edge having a length equal to that of the outer edge of the curved roadway section 14. Coupling of the large radius roadway section 72 to the curved roadway section 14 is accomplished using the magnetic coupler 70. Using these components, the user can construct a roadway having a width twice that of the roadway sections 12, 14. The magnetic coupler 70 has a transverse dimension that is twice the transverse dimension of a standard magnetic coupler 26 to allow connection of two roadway sections placed side-by-side.

The width of the roadway surface of the track 10 could also be changed by using roadway sections 12, 14 of a different width. By using the dual-width method discussed above, however, it is possible to compile a kit or a set of components that allow the user to construct either a single-width track or a dual-width track depending on user preference. Also, this method allows a minimization in the number of distinct components that must be included in such a kit by allowing the straight roadway sections 12 to be placed side-by-side to create the dual-width track. It is also possible to create a triple-width track (or any greater integer multiple of the single track section) using the same principles described above, provided that appropriate larger radius curved roadway sections (not shown) are constructed.

To construct the inner guardrail 18 and the outer guardrail 20 around the periphery of the roadway surface, a guardrail support having twice the base length of the base 34 of the guardrail support 28 is employed. All other components of the inner guardrail 18 and the outer guardrail 20 are identical to those employed in the single-width track.

The present invention is amenable to organization as a kit including numerous components allowing a user to construct an infinite variety of track configurations. The various components of such a kit may include straight roadway sections 12, curved roadway sections 14, large radius roadway sections 72, magnetic couplers 26, magnetic couplers 70, guardrail supports 28 of two different widths, guardrail strips 30, protective caps 32, bridge support surfaces 42, entry ramps 44, fastening loops 46, radius intersections 50, straight intersecting sections 56, and Y-type intersection sections 62. Any number of these various components may be assembled into a kit for allowing assembly of the track 10 of the present invention.

Although the present invention is described with respect to a track having an oval configuration, any number of other configurations could also be constructed. It is not necessary that the track configuration form a closed loop. The track could be configured with one or more open ends. Also, any type of magnetic coupling configurations could be used to releasably couple roadway sections.

Figure 7:
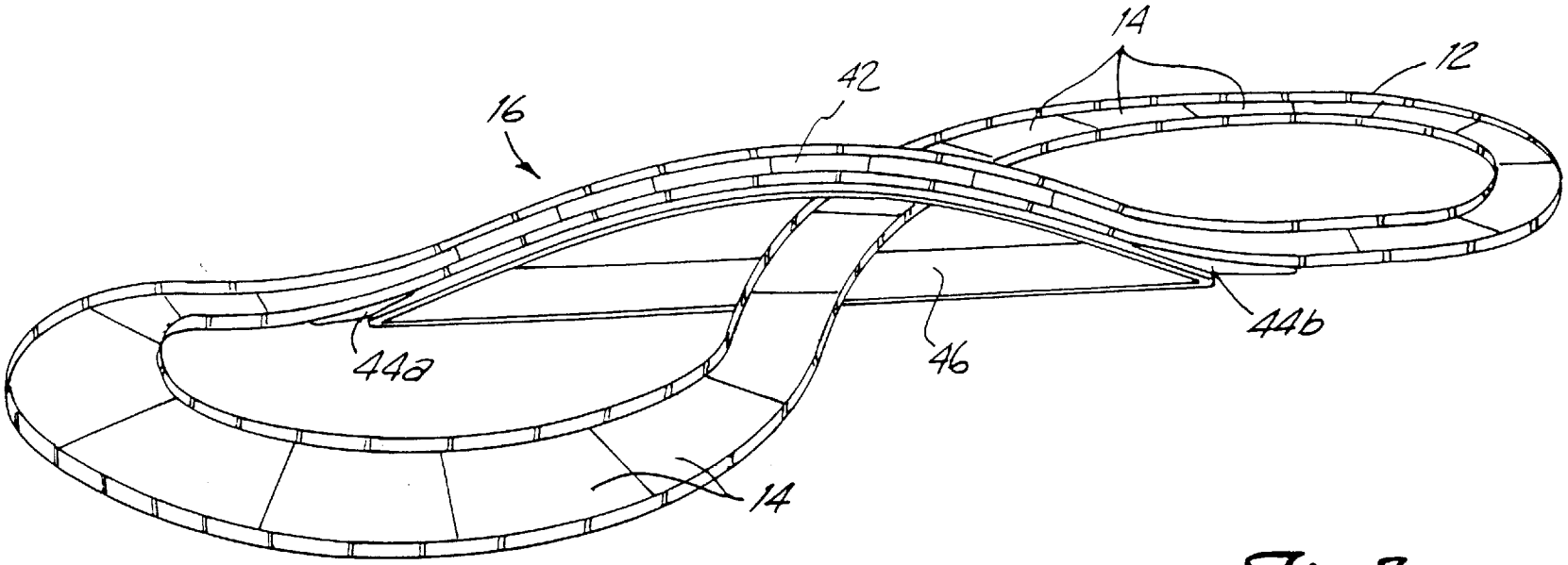
FIGS. 7–9 are perspective views of various roadways constructed pursuant to the present invention.
Figure 8:
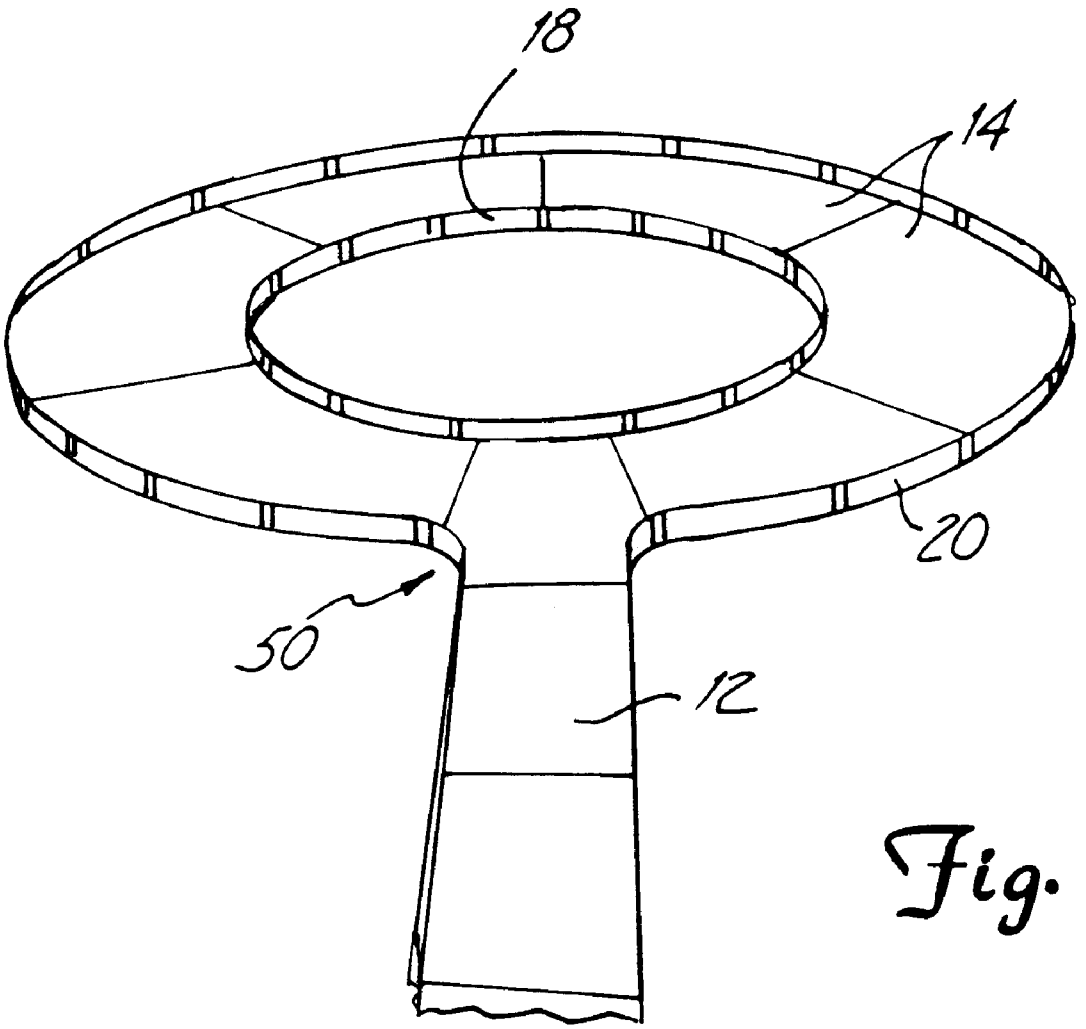
Figure 9:
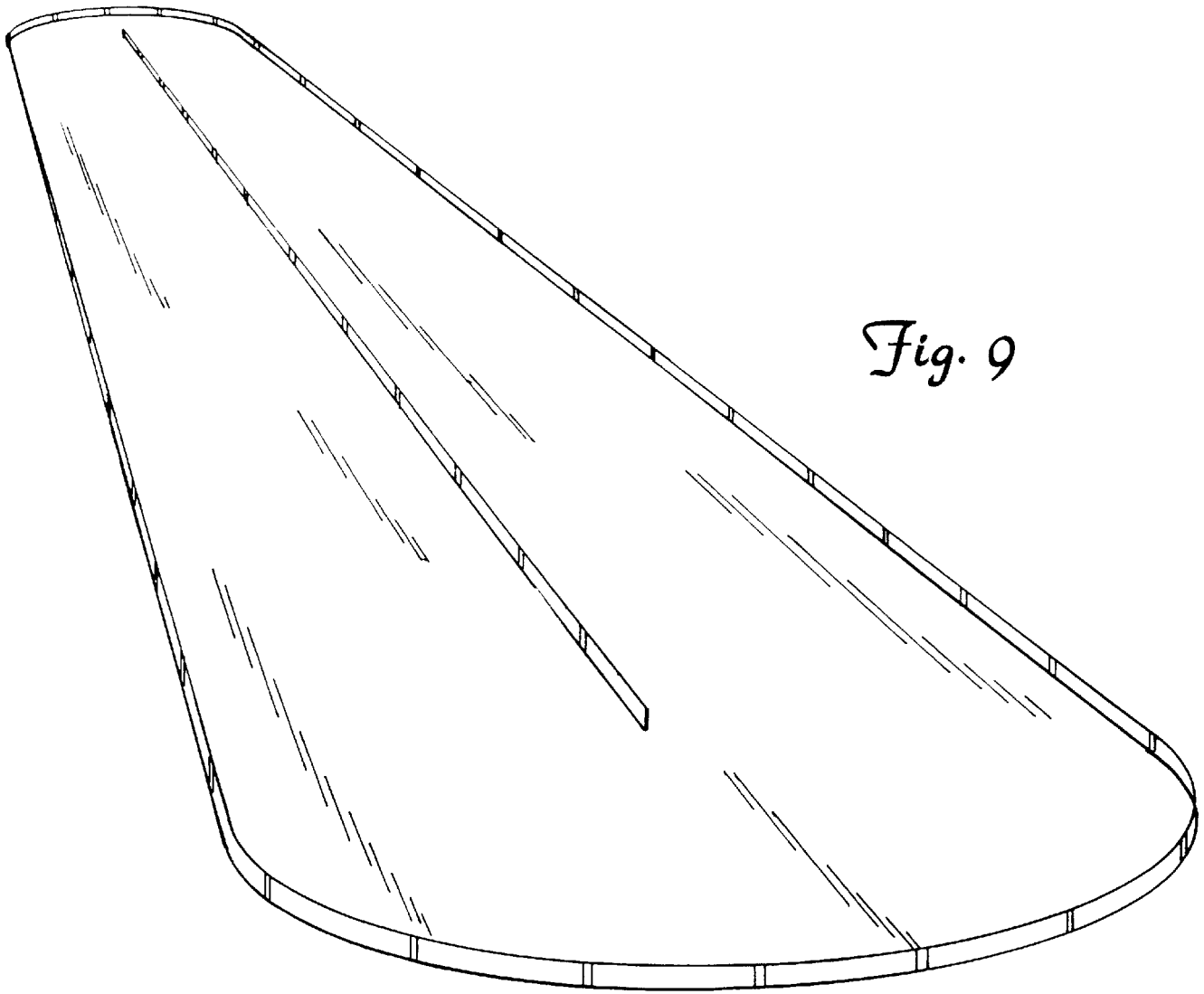

FIGS. 7–9 show three other alternative track configurations that may be constructed according to the present invention. FIG. 7 shows a single-width track configuration in which the track loops back and travels under the bridge 16. This track configuration then loops back again to connect to the track origin and provide a closed loop. FIG. 8 shows a single-width track configuration using the radius intersection 50 to connect a circular track portion to a straight track portion. A Y-type intersection section 62 could also be conveniently used with this track configuration in place of the radius intersection 50. FIG. 9 shows a dual-width raceway-type track configuration in the shape of an oval. FIGS. 7–9 are not necessarily drawn to scale but are shown for the purpose of providing example track configurations.

Although the present invention has been described with reference to preferred embodiments, workers skilled in the art will recognize that changes may be made in form and detail without departing from the spirit and scope of the invention.

What is claimed is:

1. A toy vehicle track comprising:

a plurality of flexible roadway sections having magnetic strips attached to a lower surface thereof; and a magnetic coupling that interacts with the magnetic strips for connecting the flexible roadway sections to each other.

2. The toy vehicle track of claim 1 further comprising a guardrail coupled to the plurality of roadway sections, the guardrail disposed normal to and traversing the longitudinal periphery of the plurality of roadway sections.

3. The toy vehicle track of claim 1 further comprising a bridge coupled to a roadway section on a first end and coupled to a roadway section on a second end.

4. The toy vehicle track of claim 2 wherein the bridge includes a bridge surface and a fastening strap, the fastening strap connecting to a first end of the bridge surface and to a second end of the bridge surface to maintain the bridge surface in a curved configuration.

5. The toy vehicle track of claim 1 wherein the plurality of roadway sections includes at least one straight roadway section and at least one curved roadway section for constructing tracks having a variety of configurations.

6. The toy vehicle track of claim 1 wherein a first roadway section is disposed laterally adjacent to a second roadway section such that a dual-width track is thereby constructed.

7. The toy vehicle track of claim 1 wherein the plurality of roadway sections is constructed from a soft rubber material.

8. The toy vehicle track of claim 4 wherein the plurality of roadway sections are coupled to each other such that a closed roadway circuit is formed.

9. The toy vehicle track of claim 7 wherein the plurality of roadway sections further includes at least one intersecting roadway section for connecting one of the plurality of roadway sections to the closed roadway circuit.

10. The toy vehicle track of claim 1 wherein the guardrail includes at least one guardrail support, extending under one of the plurality of roadway sections, configured to allow the guardrail to fold down undamaged upon application of a downward directed force.

11. The toy vehicle track of claim 9 wherein the guardrail further includes a flexible strip supported by the guardrail supports and a protective covering for placing over the flexible strip.

12. A toy vehicle track comprising:

a plurality of rubber roadway sections having a first magnetic strip and a second magnetic strip attached to a lower surface of a first end and a second end, respectively;

a magnetic coupling for connecting the first magnetic strip of one roadway section to the second magnetic strip of another roadway section;

a guardrail coupled to the plurality of roadway sections, the guardrail disposed normal to and traversing the longitudinal periphery of the plurality of roadway sections; and the guardrail having at least one guardrail support configured to allow the guardrail to fold down undamaged upon application of a downward directed force.

13. The toy vehicle track of claim 11 further comprising a bridge coupled to a roadway section on a first end and coupled to a roadway section on a second end.

14. The toy vehicle track of claim 11 wherein the bridge includes a bridge surface and a fastening strap, the fastening strap connected to a first end of the bridge surface and to a second end of the bridge surface to maintain the bridge surface in a curved configuration.

15. The toy vehicle track of claim 11 wherein the plurality of roadway sections includes at least one straight roadway section and at least one curved roadway section for constructing tracks having a variety of configurations.

16. The toy vehicle track of claim 11 wherein a first roadway section is disposed laterally adjacent to a second roadway section such that a dual-width track is thereby constructed.

17. The toy vehicle track of claim 15 wherein the plurality of roadway sections further includes at least one intersecting roadway section for connecting one of the plurality of roadway sections to the closed roadway circuit.

18. The toy vehicle track of claim 11 wherein the guardrail further includes a flexible strip supported by the guardrail supports and a protective covering for placing over the flexible strip.

19. The toy vehicle track of claim 11 wherein the plurality of rubber roadway sections are constructed from ethylene propylene diene (EPDM).

20. A toy vehicle track comprising:

a plurality of roadway sections having magnetic strips attached to a lower surface thereof, the plurality of roadway sections including at least one straight roadway section and at least one curved roadway section; and a magnetic coupling that interacts with the magnetic strips for connecting the roadway sections to each other.

* * * * *